US008302438B2

(12) United States Patent
Lui

(10) Patent No.: US 8,302,438 B2
(45) Date of Patent: Nov. 6, 2012

(54) DRIVING DEVICE FOR AN ELECTRIC LOCK LATCH

(76) Inventor: Pang-Cheng Lui, Taoyuan County (TW)

( * ) Notice: Subject to any disclaimer, the term of this patent is extended or adjusted under 35 U.S.C. 154(b) by 0 days.

(21) Appl. No.: 13/449,455

(22) Filed: Apr. 18, 2012

(65) Prior Publication Data

US 2012/0198897 A1 Aug. 9, 2012

Related U.S. Application Data

(63) Continuation-in-part of application No. 12/591,169, filed on Nov. 12, 2009.

(51) Int. Cl.
*E05B 47/00* (2006.01)

(52) U.S. Cl. ..... 70/277; 70/278.7; 70/279.1; 70/280; 70/283; 74/89.23; 74/89.36; 74/424.71; 74/424.73; 74/424.75; 74/424.77; 74/411; 74/57

(58) Field of Classification Search ..... 70/277, 70/278.7, 279.1, 280, 283; 74/89.23, 89.36, 74/424.71, 424.73, 424.75, 424.77, 411, 74/57

See application file for complete search history.

(56) References Cited

U.S. PATENT DOCUMENTS

| | | | | | |
|---|---|---|---|---|---|
| 1,846,257 | A * | 2/1932 | Huck | 188/218 A |
| 2,166,426 | A * | 7/1939 | Dickson | 267/176 |
| 2,451,067 | A * | 10/1948 | Butler | 204/248 |
| 2,898,102 | A * | 8/1959 | Armstrong | 267/167 |
| 5,083,122 | A * | 1/1992 | Clark | 340/5.22 |
| 5,628,216 | A * | 5/1997 | Qureshi et al. | 70/278.7 |
| 5,692,599 | A * | 12/1997 | Winter | 200/401 |
| 5,709,371 | A * | 1/1998 | Balsells | 267/167 |
| 5,924,683 | A * | 7/1999 | Alchin | 267/178 |
| 6,375,174 | B2 * | 4/2002 | Hasegawa et al. | 267/167 |
| 6,450,315 | B1 * | 9/2002 | Blessinger et al. | 192/70.252 |
| 6,460,903 | B1 * | 10/2002 | Ming-Chih | 292/172 |
| 6,966,549 | B2 * | 11/2005 | Costello et al. | 267/89 |
| 7,055,812 | B2 * | 6/2006 | Balsells | 267/167 |
| 7,568,682 | B2 * | 8/2009 | Seelmann et al. | 267/179 |
| 7,918,114 | B2 * | 4/2011 | Walsh, III | 70/283 |
| 7,929,859 | B2 * | 4/2011 | Saiki | 396/543 |
| 2008/0295550 | A1 * | 12/2008 | Schmidt | 70/144 |
| 2009/0025438 | A1 * | 1/2009 | Don et al. | 70/224 |

* cited by examiner

*Primary Examiner* — Lloyd Gall
*Assistant Examiner* — Ifeolu Adeboyejo
(74) *Attorney, Agent, or Firm* — Rosenberg, Klein & Lee

(57) ABSTRACT

A driving device for an electric lock latch, comprises a housing, a motor having a power output shaft connected to a drive shaft with an external thread on a part thereof, an unequal diameter coil spring having a cylindrical spiral in the middle thereof screwing with the drive shaft, and a first and second conical spiral on both end thereof not screwing with the drive shaft, and a lock latch secured to the second conical spiral. The drive shaft is driven and rotated by a motor to pass the rotation power to the cylindrical spiral, and a rotary motion of the drive shaft is converted into a linear motion of the unequal diameter coil spring for moving the lock latch to change the locked and unlocked state of the lock device. Accordingly, the lock structure and the installation thereof may be simplified and the power-saving effect is achieved.

5 Claims, 9 Drawing Sheets

DRIVING DEVICE FOR AN ELECTRIC LOCK LATCH

This patent application is a continuation-in-part of Ser. No. 12/591,169, filed on 12 Nov. 2009, currently pending.

BACKGROUND OF THE INVENTION

1. Field of the Invention

The invention relates to a driving device for an electric lock latch, and more particularly to a structure with a drive shaft having an external threaded for driving an unequal diameter spiral spring in threaded connection thereto. Moreover, the lock latch is connected at the external part of the spiral spring. As a result, the circular motion of the drive shaft is converted into the rectilinear motion of the spiral spring such that the lock latch is moved. In this way, the locked and unlocked state of the lock device may be changed by the movement of the lock latch. Moreover, the structure of the invention can be applied to all kinds of lock devices.

2. Description of the Related Art

It is quite normal that the lock employs an electromagnetic valve to control the movement of the latch, thereby changing the locked or unlocked state. Such a structure is disclosed in the U.S. Pat. No. 6,082,791. However, the activation of the electromagnetic valve requires a large power consumption. Therefore, it is necessary to provide an external power source and a control unit for the electric lock latch using the electromagnetic valve. As a result, the installer must have the electronic knowledge and the installation skill, thereby causing much difficulty for the installer.

In order to move the lock latch via the electromagnetic valve, a motor may be used to impart a motion to the lock latch. U.S. Pat. No. 5,697,798 "MOTORIZED LOCK ACTUATORS", U.S. Pat. No. 5,628,216 "LOCKING DEVICE" and U.S. Pat. No. 6,076,870 belong to such a structure. "Motorized electric strike" disclosed in U.S. Pat. No. 6,076,870 relates to an electric strike with a pivoting locking member for locking an electric strike in the closed position. The locking member is pivoted between the locked and unlocked positions by a low current motor. A drive pin pivotally engages the locking member. The motor rotates a roll pin threadably engaging the coil faces of a spring mounted to the drive pin. Rotation of the motor compresses or expands the spring to axially move the drive pin and thereby pivot the locking member between the locked and unlocked positions.

However, the structure according to the U.S. Pat. No. 6,076,870 employs a motor to impart a rotary motion to the roll pin, thereby biasing the spring in a retracted or extended position. In this way, the drive pin is axially moved to bring the locking member between the locked and unlocked positions. The spring is equidimensionally formed. The time to supply power to the motor must be exactly controlled to prevent the breakdown of the spring due to over-compression or over-extension when the spring is moved by the rotation of the roll pin. Moreover, the installation of the roll pin and the drive pin according to the U.S. Pat. No. 6,076,870 is complicated. Therefore, a further improvement is required.

With reference to FIGS. 1A and 1B, U.S. Pat. No. 5,628,216 discloses a lucking device comprising a spring 60 being fixed to a guide member 62 at one end such that the spring 60 rotates with the shaft of a gear head 63 and, thus, with the shaft of a motor 67. During rotation of the motor shaft in a first direction, a pin 110 engages the free end of the spring 60 such that a plug 58 moves towards a motor 67 placing a locking device 10 in the locked position. Moving the motor shaft in a second direction opposite the first direction, the pin 110 engages the free end of spring 60 such that the plug 58 moves away from the motor 67, placing the locking device. The prior invention is quiet as to the diametric proportion of the spring 60. However, the shape of the spring 60 can be inferred from FIG. 1A and it illustrates spring 60 having a constant diametric proportion. Moreover, the first end of spring 60 is fixed to guide member 62.

Based on the features disclosed in U.S. Pat. No. 5,628,216, the spring 60 rotates with the shaft of a motor 67, such that the spring 60 may be excessively compressed or may be excessively extended, resulting in an elastic fatigue and a high breakdown.

SUMMARY OF THE INVENTION

An object of the invention is to eliminate the above-mentioned drawbacks of the conventional equal diameter spring driven by a pin and to provide a driving device with an unequal diameter coil spring for an electric lock latch, wherein the middle part of the unequal diameter coil spring has a cylindrical spiral with a smaller diameter in threaded connection to an external thread of a drive shaft. Moreover, the internal and external parts of the spiral spring have a larger diameter, such that no threaded connection to the drive shaft is established. In other words, the drive shaft corresponding to the internal and external parts of the unequal diameter coil spring will be idling in order to protect the unequal diameter coil spring from damage of over-compression or over-extension.

Another object of the invention is to provide a driving device for an electric lock latch that can be easily modularized and applied to all kinds of lock devices. Accordingly, the lock structure and the installation thereof may be simplified.

In order to achieve the above-mentioned objects, the invention includes:

a) a housing;

b) a motor positioned within the housing and having a power output shaft connected to a drive shaft with an external thread on a part thereof, a diameter (d2) of a root of the external thread being larger than a diameter (d1) of the drive shaft;

c) an unequal diameter coil spring having a cylindrical spiral in a middle section thereof, a rotation sense of the unequal diameter coil spring is the same as of the external thread, an axial inner side of the cylindrical spiral outwardly enlarged and formed a first conical spiral, and an opposite side of the cylindrical spiral outwardly enlarged and formed a second conical spiral, such that the unequal diameter coil spring being a shape with small section in the middle and the enlarged conical spiral on both ends, an inner diameter (D1) of the cylindrical spiral being larger than a diameter (d2) of the root of the external thread and being smaller than an outer diameter (d3) of the crest of the external thread; the first conical spiral mounted on an external peripheral of the drive shaft, and fixed in the housing or at the motor; when the unequal diameter coil spring is in a free length, there is a screwed relation between a least a part of the cylindrical spiral and the external thread of the drive shaft, and there is not a screwed relation between both the first conical spiral and the second conical spiral t and the external thread of the drive shaft, the unequal diameter coil spring positioned within the housing for telescoping but not being rotated by the drive shaft; and d) a lock latch secured to an outer end of the second conical spiral and telescopically moved with the second conical spiral;

whereby when the motor drives the drive shaft into a forward rotation or reverse rotation, the external thread of the drive shaft passes the rotation power to the cylindrical spiral and then a rotary motion of the drive shaft is converted into a linear motion of the unequal diameter coil spring for changing an elongation or compression of the unequal diameter coil spring, such that the lock latch is moved by the second conical spiral; when the unequal diameter coil spring is stretched or compressed to a predetermined position, the external thread is idling without driving the unequal diameter coil spring even if the drive shaft is still rotating;

when the drive shaft stops rotating and the unequal diameter coil spring is compressed, the cylindrical spiral is fixed by an outer side thereof being against an inner side of the external thread for the lock latch being in a compression state;

when the drive shaft stops rotating and the unequal diameter coil spring is stretched, the cylindrical spiral is fixed by an inner side thereof being against an outer side of the external thread, forming an axial supporting force for the lock latch being in an elongation state.

DETAILED DESCRIPTION OF THE PREFERRED EMBODIMENT

Figure 1A:
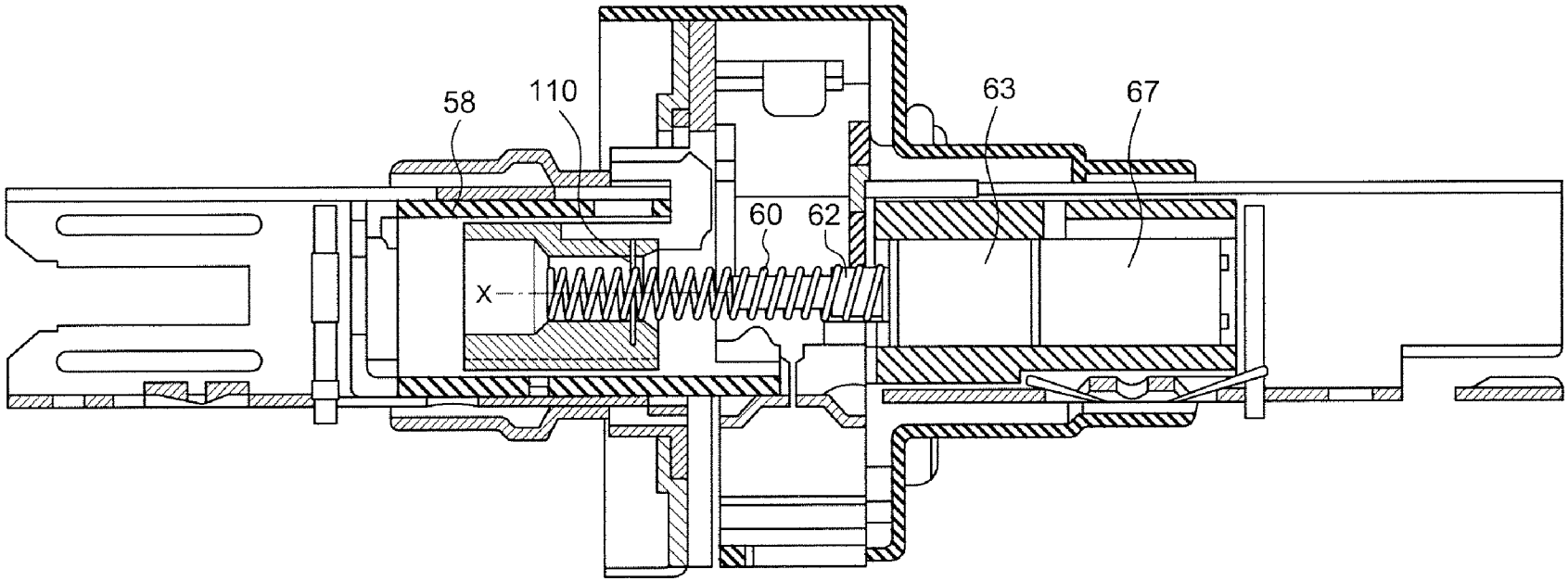
FIG.1A PRIOR ART
FIGS. 1A and 1B are sectional views of the structure of U.S. Pat. No. 5,628,216.
Figure 1B:
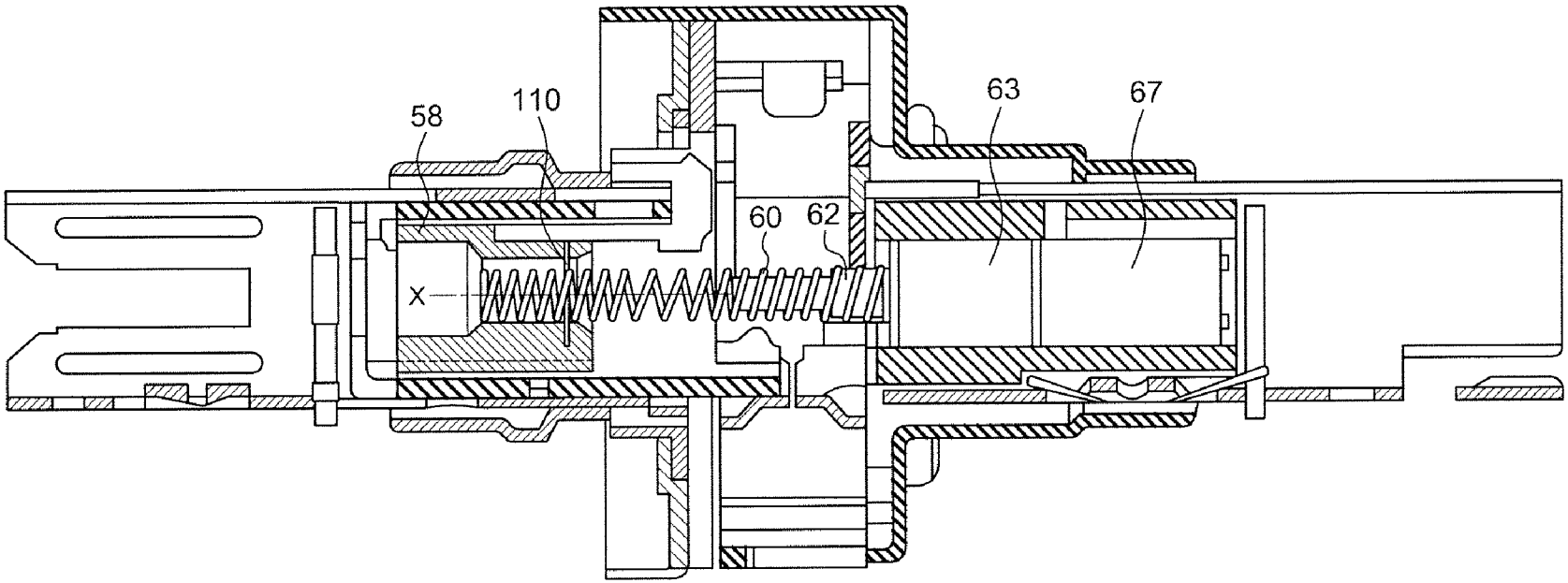
FIG.1B PRIOR ART

Referring to FIGS. 2 through 8, the preferred embodiment of a driving device 50 in accordance with the present invention comprises a housing 10, a motor 20, an unequal diameter coil spring 30, and a lock latch 40.

The housing 10 may be set into different shape. In this embodiment, the housing 10 with an opening on the top has a recessed accommodation slot 11 and a sliding slot 12 therein.

Figure 6:
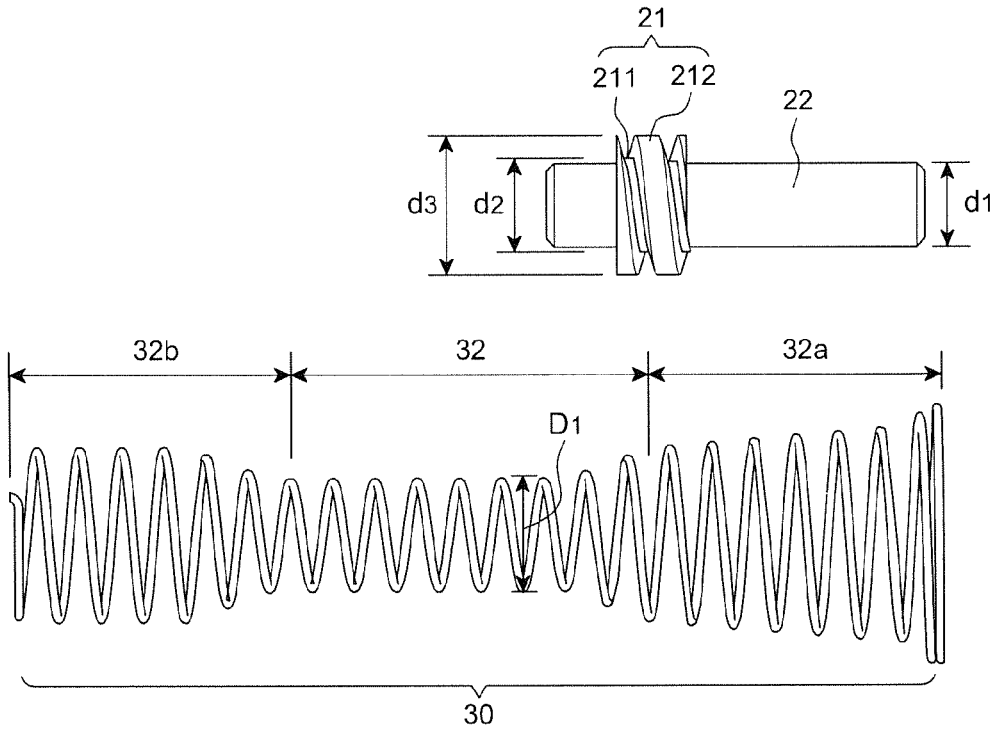
FIG. 6 is a schematic view of the structure of the drive shaft and the unequal diameter coil spring in accordance with the present invention.

The motor 20 positioned within the recessed accommodation slot 11 of the housing 10 has a power output shaft 23 connected to a drive shaft 22 with an external thread 21 on a part thereof. With reference to FIG. 6, a diameter d2 of a root 211 of the external thread 21 is larger than a diameter d1 of the drive shaft 22.

The unequal diameter coil spring 30 as shown in FIG. 6 has a cylindrical spiral 32 in a middle section thereof. A rotation sense of the unequal diameter coil spring 30 such as left rotation or right rotation is the same as of the external thread 21. Moreover, an axial inner side of the cylindrical spiral 32 is outwardly enlarged and formed a first conical spiral 32*a*, and an opposite side of the cylindrical spiral 32 is outwardly enlarged and formed a second conical spiral 32*b*, such that the unequal diameter coil spring 30 becomes a shape with small section in the middle and the enlarged conical spiral on both ends. An inner diameter D1 of the cylindrical spiral 32 is larger than a diameter d2 of the root 211 of the external thread 21 and smaller than an outer diameter d3 of the crest 212 of the external thread 21. Moreover, the first conical spiral 32*a* is mounted on an external peripheral of the drive shaft 22, and fixed in the housing 10 or at the motor 20. When the unequal diameter coil spring 30 is in a free length, there is a screwed relation between at least a part of the cylindrical spiral 32 and the external thread 21 of the drive shaft 22, and there is not a screwed relation between both first and the second conical spiral 32*a*, 32*b* and the external thread 21 of the drive shaft 22. Moreover, the unequal diameter coil spring 30 is positioned within the housing 10 for telescoping but not being rotated by the drive shaft 22.

The lock latch 40 is secured to an outer end of the second conical spiral 32*b* and telescopically moved with the second conical spiral 32*b*.

Figure 7A:
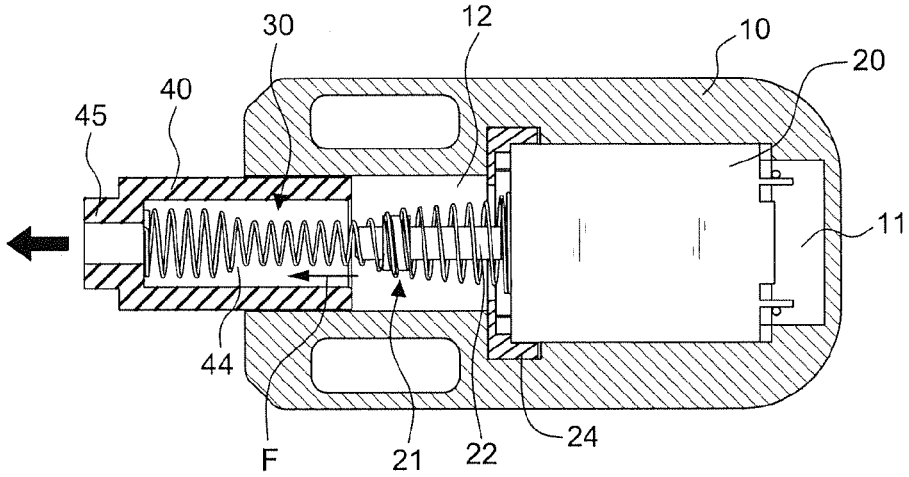
FIG. 7A is a cross-sectional view taken along with the line 7A-7A of FIG. 5, illustrating the stretching spring.
Figure 8A:
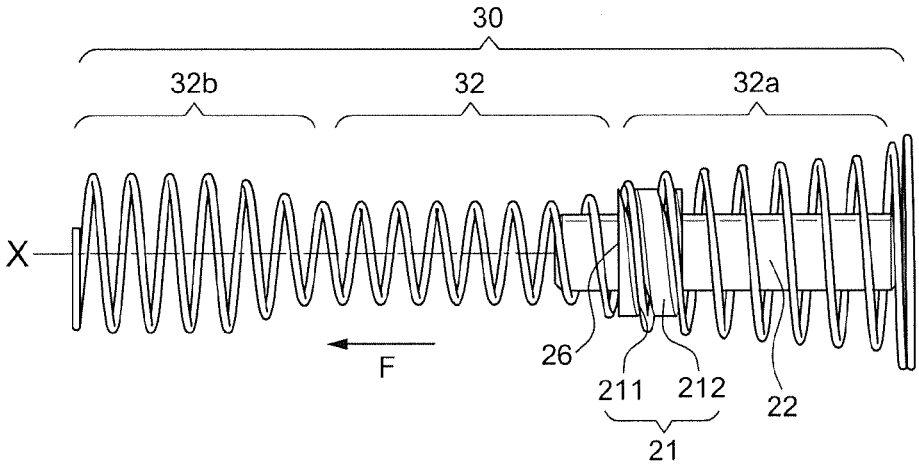
FIG. 8A is a schematic view of the main structure in FIG. 7A.

Based on the features disclosed, the preferred embodiment of the driving device 50 in accordance with the present invention is illustrated as following: FIGS. 7A and 8A illustrate the unequal diameter coil spring 30 being stretched and the lock latch 40 being in an elongation state; that is, when the motor 20 drives the drive shaft 22 into forward rotation, the external thread 21 of the drive shaft 22 passes the rotation power through the cylindrical spiral 32 and a rotary motion of the drive shaft 22 is converted into a linear motion of the unequal diameter coil spring 30 for changing the unequal diameter coil spring 30 into an elongation or compression condition, such that the lock latch 40 is telescopically moved by the second conical spiral 32*b*; when the unequal diameter coil spring 30 is stretched to a predetermined position, the predetermined length of the cylindrical spiral 32 and the border of the first conical spiral 32*a* or the second conical spiral 32*b*, the external thread 21 of the drive shaft 22 is idling without driving the movement of the unequal diameter coil spring 30 even if the drive shaft 22 is still rotating. With reference to FIG. 8, when the drive shaft 22 stops rotating and the unequal diameter coil spring 30 is stretched, the cylindrical spiral 32 is fixed by an inner side thereof being against an outer side wall 26 of the external thread 21, forming an axial supporting force F for the lock latch 40 being in an elongation state.

Figure 2:
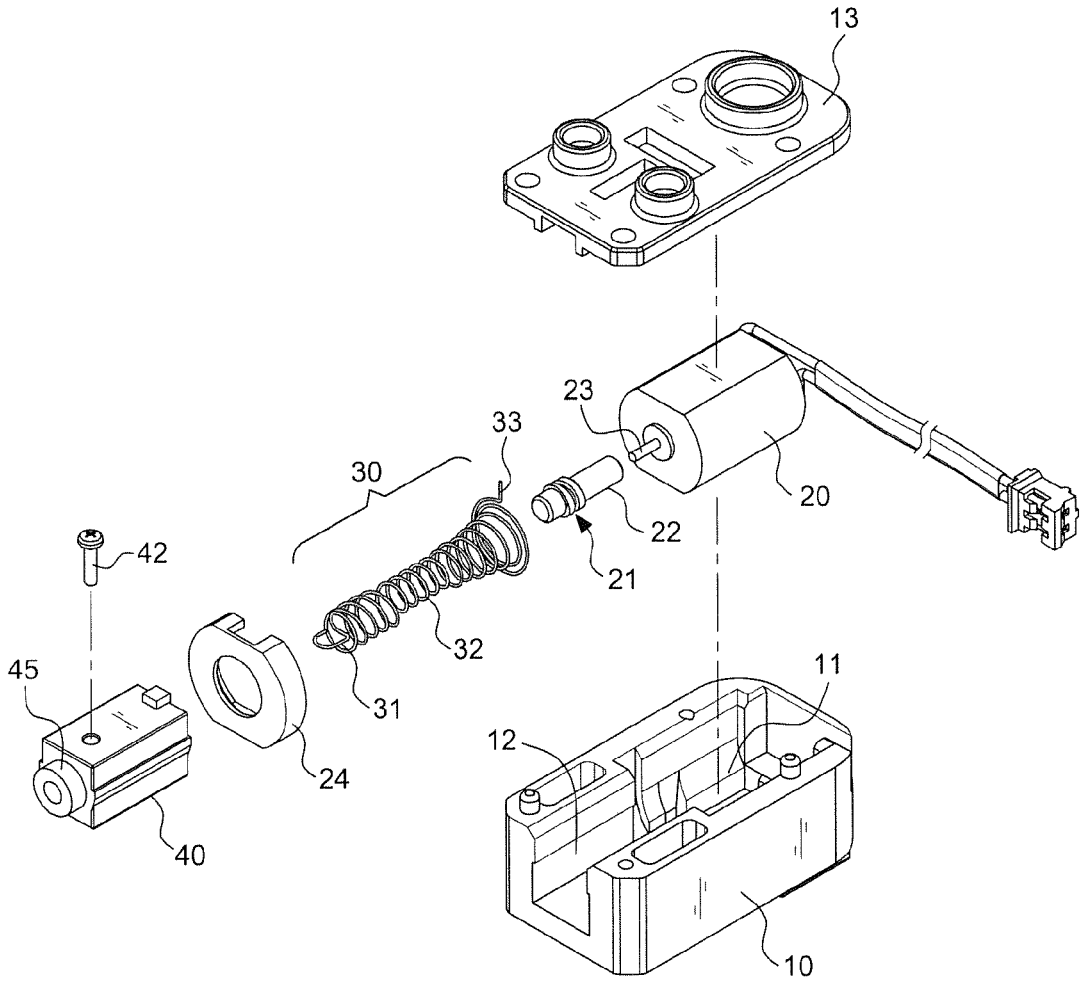
FIG. 2 is an exploded perspective view of the preferred embodiment in accordance with the invention.
Figure 3:
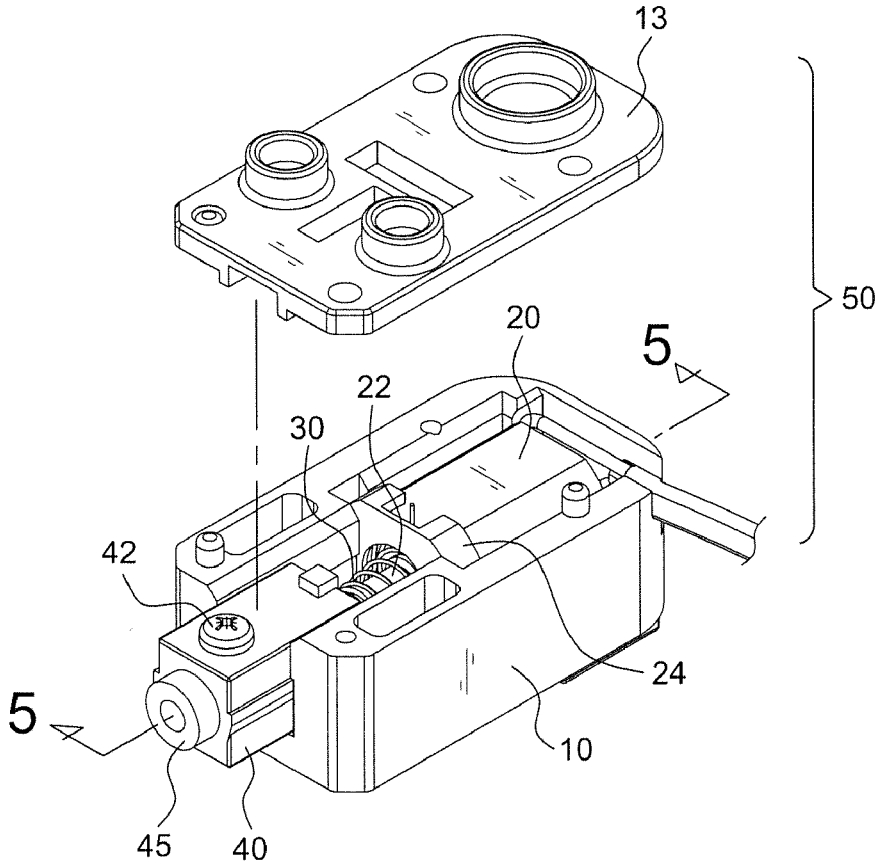
FIG. 3 is an exploded perspective view of the partial structure of the first embodiment in accordance with the invention.
Figure 4:
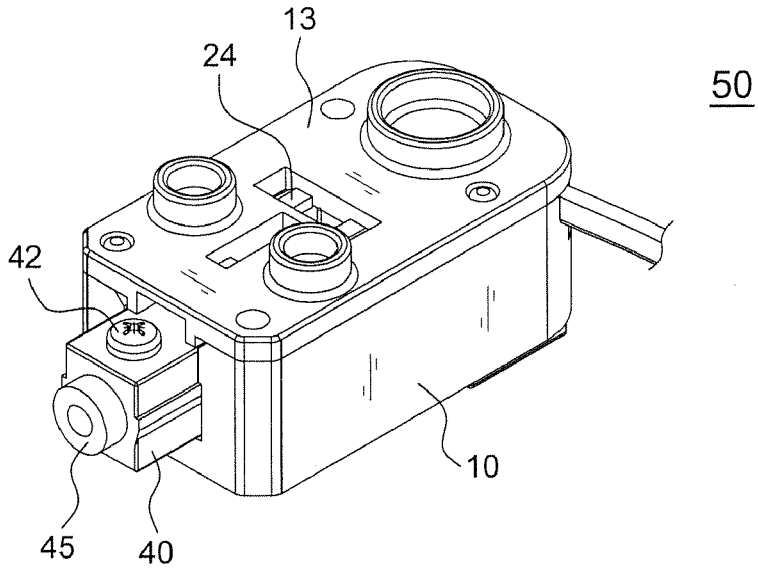
FIG. 4 is an perspective assembly view of the preferred embodiment in accordance with the invention.
Figure 5:
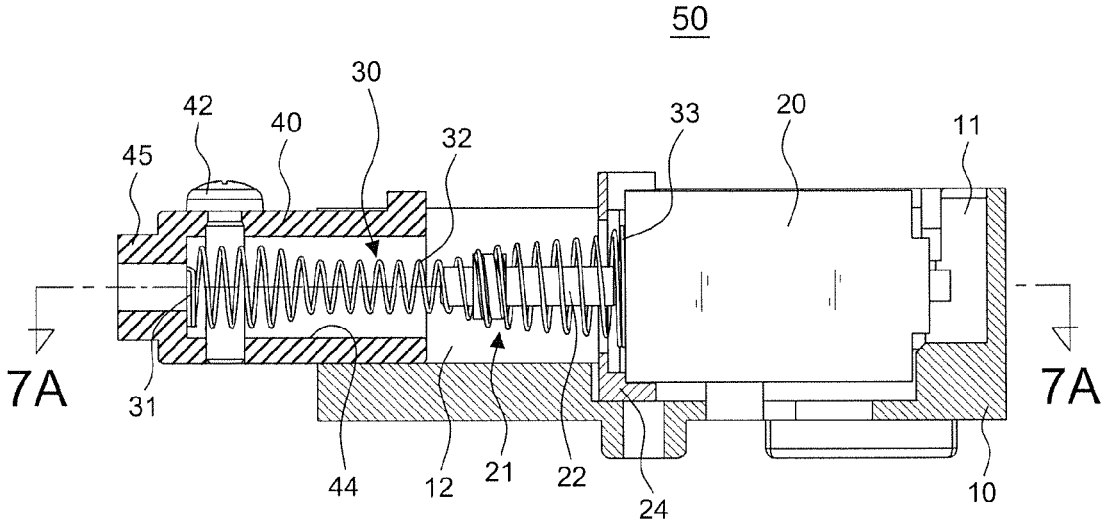
FIG. 5 is a cross-sectional view taken along with the line 5-5 of FIG. 3.

With reference to FIG. 2, the housing has a recessed accommodation slot 11 for mounting the motor 20 and a sliding slot 12 is positioned in the front of the recessed accommodation slot 11 for mounting and moving the lock latch 40, and the outer end of the lock latch 40 can be extended out of the sliding slot 12. Moreover, an outer end of the lock latch 40 may be stretched out of the sliding slot 12 and may include a convex body 45 for connecting an engaging member (not shown) of different locks. In this embodiment, a cover body 13 is provided on a top of the housing 10 and a sleeve body 24 is provided on the front side of the motor 20 for fixing an inner portion 33 of the first conical spiral 32*a* of the unequal diameter coil spring 30 and avoiding the unequal diameter coil spring 30 to be rotated by the drive shaft 22. Further, the second conical spiral 32*b* of the unequal diameter coil spring 30 has a tail loop 31 at the external end thereof, wherein the lock latch 40 corresponding to the second conical spiral 32*h* has a hollow hole 44 for being inserted by the second conical spiral 32*b*, and wherein a connection element 42 passes through the lock latch 40 and the tail loop 31 for connecting the unequal diameter coil spring 30 to the lock latch 40.

Figure 7B:
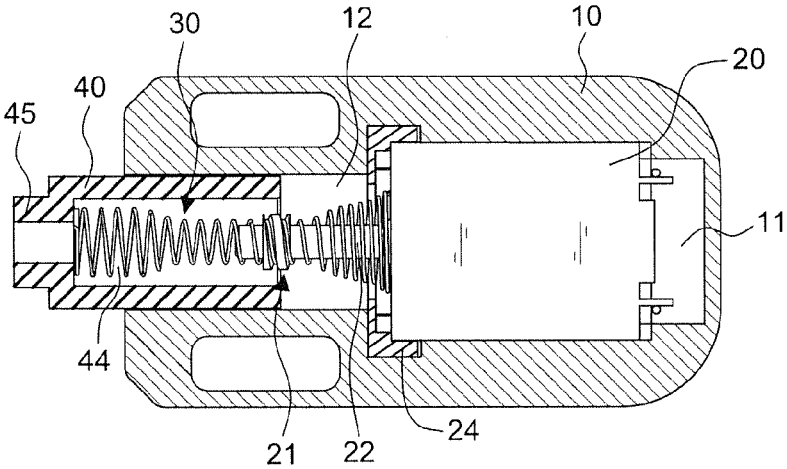
FIG. 7B is a schematic view of FIG. 7A, illustrating the compressing spring.
Figure 8B:
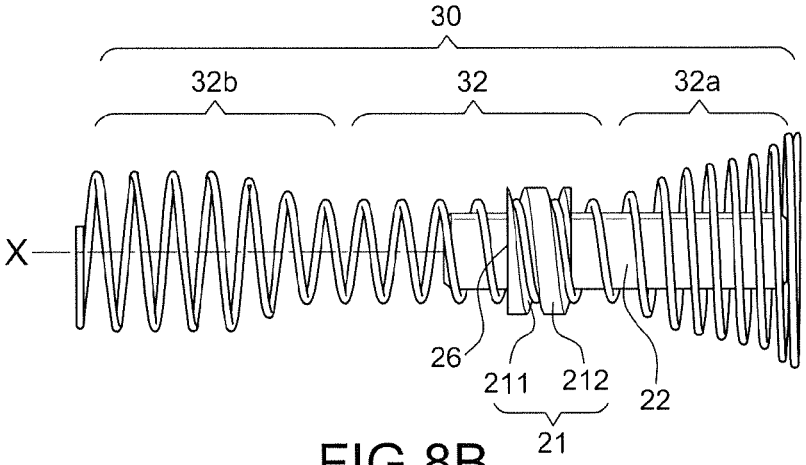
FIG. 8B is a schematic view of the main structure in FIG. 7B.

FIGS. 7B and 8B illustrate the drive draft 22 reversely rotating and driving the unequal diameter coil spring 30 into a compression condition. The important features of the present invention include: the unequal diameter coil spring 30 is a shape with small section in the middle and the enlarged conical spiral on both ends; the inner diameter D1 of the cylindrical spiral 32 is larger than the diameter d2 of the root 211 of the external thread 21 and smaller than the outer diameter d3 of the crest 212 of the external thread 21. Therefore, when the drive shaft 22 reversely rotates, the external thread 21 of the drive shaft 22 passes the rotation power through the cylindrical spiral 32 and the rotary motion of the drive shaft 22 is converted into the linear motion of the unequal diameter coil spring 30 for changing the unequal diameter coil spring 30 into the compression condition. Most importantly, when the drive shaft 22 rotates and drives the unequal diameter coil spring 30, the unequal diameter coil spring 30 is not rotated but being compressed and moved telescopically, which has the same results while the unequal diameter coil spring 30 is stretched.

Figure 7C:
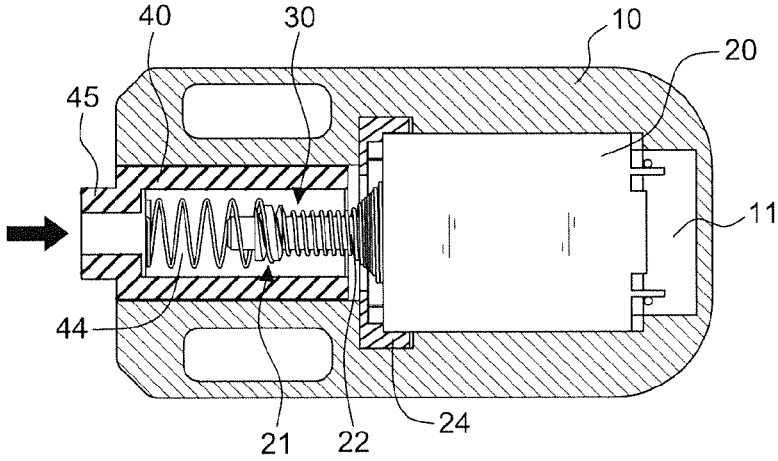
FIG. 7C is a schematic view of FIG. 7B, illustrating the spring is compressed to the inner side.
Figure 8C:
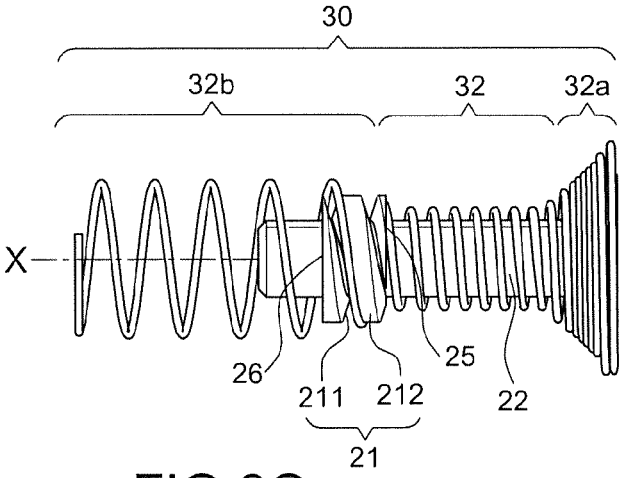
FIG. 8C is a schematic view of the main structure in FIG. 7C.

With reference to FIGS. 7C and 8C, when the unequal diameter coil spring 30 is compressed to a predetermined position, the lock latch 40 is compressed to a compression state. At this time, if the drive shaft 22 is still rotating, the present invention uses the features of the outer diameters of both root 211 and crest 212 of the external thread 21, and the design of the unequal diameter coil spring 30 with different inner diameters in the middle section and at both ends, such that the cylindrical spiral 32 as shown in FIG. 8 is compressed between the motor 20 and the external thread 21, and the external thread 21 of the drive shaft 22 does not screw to the cylindrical spiral 32 but being idling. When the drive shaft 22 stops rotating, the cylindrical spiral 32 is fixed by an outer side thereof being against an inner side wall 25 of the external thread 21; that is, the unequal diameter coil spring 30 as shown in FIG. 7C is connected to the lock latch 40 for being in a compression state.

With reference to FIG. 8, the first conical spiral 32*a* of the unequal diameter coil spring 30 is compressed to the right by the cylindrical spiral 32 of the unequal diameter coil spring 30 in order to reduce the volume and the drive resistance of the motor 20, and save power.

Figure 9:
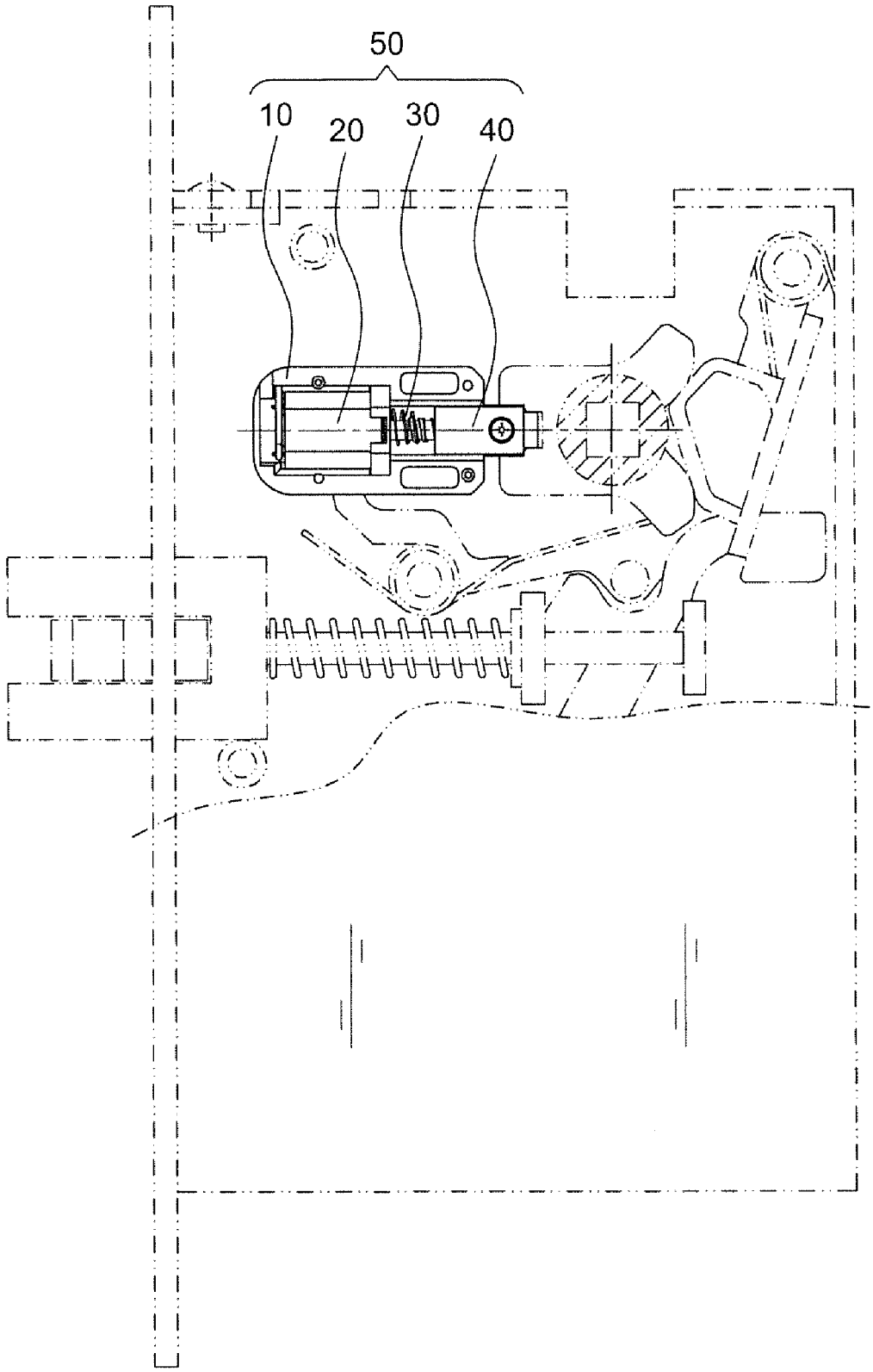
FIG. 9 is an application example of the present invention applied to a first type mortise lock.
Figure 10:
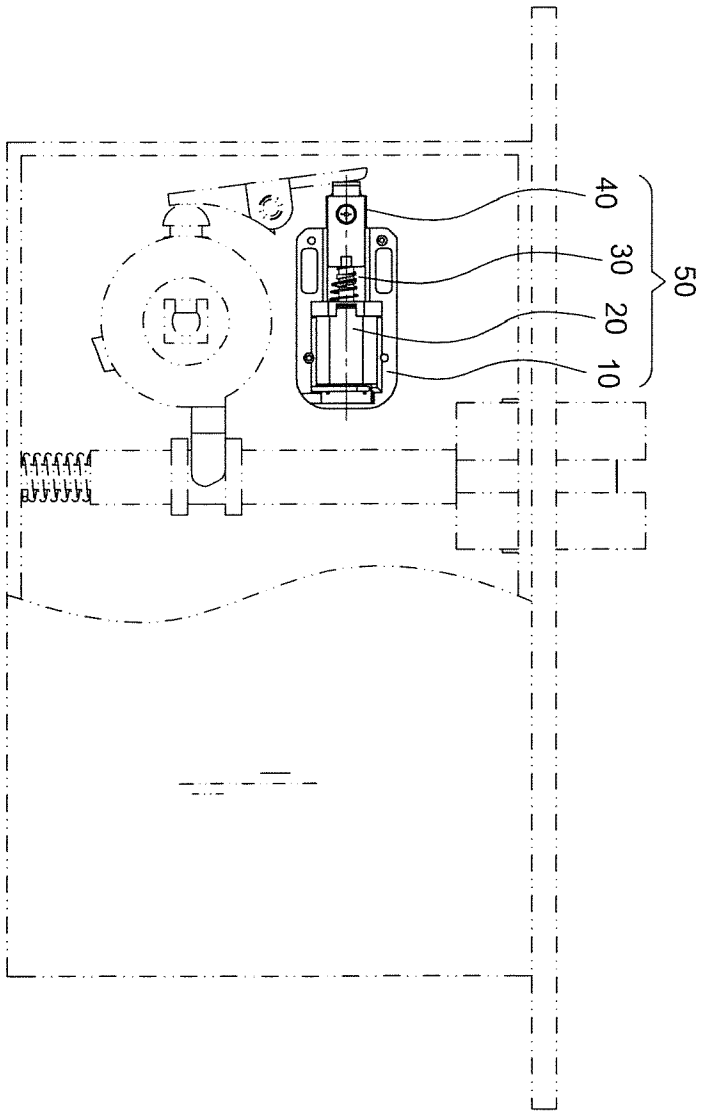
FIG. 10 is an application example of the invention applied to a second type mortise lock.

With reference to FIG. 9, the driving device 50 of the invention is applied to a first type Mortise lock, illustrating a direct control locking element. With reference to FIG. 10, the driving device 50 of the invention is applied to a second type Mortise lock, illustrating an indirect control locking element. However, the structure of the invention has various applications that are not detailed hereinafter. In addition, they are not the object of the invention so that no further descriptions thereto are given hereinafter.

Both the driving device 50 of the present invention and U.S. Pat. No. 5,628,210 include a kind of coil spring. However, the structure and the effects of the coil spring are different, illustrating again as following:

1. U.S. Pat. No. 5,628,210 has an equal diameter coil spring 60 and an inner end thereof fixed on a guide member 62 is rotated by the guide member 62. On the other hand, the present invention has the unequal diameter coil spring 30 that is not rotated by the drive shift 22 but moving telescopically. Therefore, the transmission ways between the two are completely different.

2. The present invention has the unequal diameter coil spring 30 with a cylindrical spiral 32 in a middle section thereof, the first and second conical spiral 32*a*, 32*b* on both ends. This unique shape of the unequal diameter coil spring 30 has features that the inner diameter D1 of the cylindrical spiral 32 is larger than the diameter d2 of the root 211 of the external thread 21 and is smaller than the outer diameter d3 of the crest 212 of the external thread 21, such that the drive shaft 22 will be idling at the first and second conical spiral 32*a*, 32*b*. The movement position of the lock latch 40 may be controlled by the length of the cylindrical spiral 32. As a result, it is not necessary to exactly control the duration of the power supply to the motor. In addition, the spring may be protected from damage due to over-compression or over-extension. Consequently, the motor 20 of the invention may activate the lock latch 40 with a slight power consumption to change its position. That is, the battery can supply the power needed. It is not necessary to connect to the mains. The structure and the assembly are both very simple. Accordingly, the lock structure and the installation thereof can be simplified.

Based on the technical features disclosed, the present invention not only overcomes the problem of conventional probes which is not easy to assemble and manufacture but improves the poor isolation caused by the signal coupling of the probes. The present invention achieves both easy assembly for saving costs and high signal isolation effects.

What is claimed is:

1. A driving device for an electric lock latch, comprising:

a) a housing;

b) a motor positioned within the housing and having a power output shaft connected to a drive shaft with an external thread on a part thereof, a diameter (d2) of a root of the external thread being larger than a diameter (d1) of the drive shaft;

c) an unequal diameter coil spring having a cylindrical spiral in a middle section thereof, the unequal diameter coil spring corresponding in a spiral direction with the external thread, an axial inner side of the cylindrical spiral outwardly enlarged and forming a first conical spiral, and an opposite side of the cylindrical spiral outwardly enlarged and forming a second conical spiral, such that the unequal diameter coil spring being a shape with small section in the middle and the enlarged conical spiral on both ends, an inner diameter (D1) of the cylindrical spiral being larger than a diameter (d2) of the root of the external thread and being smaller than an outer diameter (d3) of the crest of the external thread; the first conical spiral mounted on an external peripheral of the drive shaft, and fixed in the housing or at the motor; when the unequal diameter coil spring is in a free length, there is a screwed relation between a least a part of the cylindrical spiral and the external thread of the drive shaft, and there is not a screwed relation between both the first conical spiral and the second conical spiral and the external thread of the drive shaft, the unequal diameter coil spring positioned within the housing for telescoping but not being rotated by the drive shaft; and d) a lock latch secured to an outer end of the second conical spiral and telescopically moved with the second conical spiral;

whereby when the motor drives the drive shaft into a forward rotation or reverse rotation, the external thread of the drive shaft passes the rotation power to the cylindrical spiral and then a rotary motion of the drive shaft is converted into a linear motion of the unequal diameter coil spring for changing an elongation or compression of the unequal diameter coil spring, such that the lock latch is moved by the second conical spiral; when the unequal diameter coil spring is stretched or compressed to a predetermined position, the external thread is idling without driving the unequal diameter coil spring even if the drive shaft is still rotating;

when the drive shaft stops rotating and the unequal diameter coil spring is compressed, the cylindrical spiral is fixed by an outer side thereof being against an inner side of the external thread, compressing the lock latch for being in a compression state;

when the drive shaft stops rotating and the unequal diameter coil spring is stretched, the cylindrical spiral is fixed by an inner side thereof being against an outer side of the external thread, forming an axial supporting force for the lock latch being in an elongation state.

2. The driving device for an electric lock latch as recited in claim 1, wherein the housing has a recessed accommodation slot for mounting the motor and a sliding slot positioned in the front of the recessed accommodation slot for mounting and moving the lock latch, and the outer end of the lock latch can be extended out of the sliding slot.

3. The driving device for an electric lock latch as recited in claim 2, further comprising a cover body provided on a top of the housing.

4. The driving device for an electric lock latch as recited in claim 1, further comprising a sleeve body provided on the front side of the motor for fixing an inner end of the first conical spiral of the unequal diameter coil spring, so that the unequal diameter coil spring cannot be rotated.

5. The driving device for an electric lock latch as recited in claim 1, wherein the second conical spiral of the unequal diameter coil spring has a tail loop at the external end thereof, the lock latch corresponding to the second conical spiral has a hollow hole for the second conical spiral to insert, and a connection element passes through the lock latch and the tail loop for connecting the unequal diameter coil spring to the lock latch.

* * * * *